United States Patent [19]

Narayan

[11] 4,272,570

[45] Jun. 9, 1981

[54] PROVISION OF SURFACE LAYERS OF COPPER OR COPPER ALLOYED WITH ZINC ON DIE CASTINGS OF ZINC OR ZINC ALLOYS

[75] Inventor: Raichur S. Narayan, Schaumburg, Ill.

[73] Assignee: Sunbeam Corporation, Chicago, Ill.

[21] Appl. No.: 139,388

[22] Filed: Apr. 11, 1980

[51] Int. Cl.[3] ..... C23C 3/02

[52] U.S. Cl. ..... 427/436; 427/437; 106/1.23; 106/1.26

[58] Field of Search ..... 427/436, 434.5, 437; 106/1.23, 1.26

[56] References Cited

U.S. PATENT DOCUMENTS

| | | | |
|---|---|---|---|
| 43,557 | 7/1864 | Weil | 106/1.23 |
| 3,033,703 | 5/1962 | Schneble et al. | 427/305 |
| 3,046,159 | 7/1962 | Brookshire | 106/1.26 |
| 3,664,933 | 5/1972 | Clauss | 106/1.23 |
| 3,716,462 | 2/1973 | Jensen | 106/1.23 |
| 4,036,651 | 7/1977 | Weiner | 106/1.26 |
| 4,199,623 | 4/1980 | Nuzzi et al. | 427/305 |

OTHER PUBLICATIONS

Lowenheim, Ed., Modern Electroplating, Wiley-Interscience (1974) 3rd Edition, pp. 613-615, 776, 605, 6, 7, 448-495.

Metals Handbook, vol. 2, (American Soc. for Metals, 8th Ed. 1964) pp. 458-460.

*Primary Examiner*—Ralph S. Kendall

*Attorney, Agent, or Firm*—George R. Clark; Neil M. Rose; Allen J. Hoover

[57] ABSTRACT

A process for providing surface layers of copper or copper alloyed with zinc on die castings of zinc or zinc alloys comprises a step of immersing the castings in an agitated bath containing an aqueous vehicle, which has been adjusted to a pH of from 8 to 10, and to which cupric oxide has been added as a powder in an amount of approximately from 200 to 250 grams per liter of the agitated bath. Cuprous oxide may be substituted for cupric oxide. At a pH not exceeding 8.5, the surface layer tends to be copper alloyed with zinc. At a pH exceeding 8.5, the surface layer tends to be copper. At a pH of 9, the surface layer of copper tends to be very adherent. The pH is adjusted by addition of sodium hydroxide, potassium hydroxide, or ammonium hydroxide, preferably sodium hydroxide.

7 Claims, No Drawings

PROVISION OF SURFACE LAYERS OF COPPER OR COPPER ALLOYED WITH ZINC ON DIE CASTINGS OF ZINC OR ZINC ALLOYS

BACKGROUND OF THE INVENTION

This invention pertains to a process for providing surface layers of copper or copper alloyed with zinc on die castings of zinc or zinc alloys, particularly but not exclusively as a pretreatment before conventional nickel plating, which may be followed by decorative chromium plating.

As a pretreatment of die castings of zinc alloys before electroless nickel plating, which may be followed by decorative chromium plating, it is conventional for a copper strike to be applied in an electroplating bath containing copper cyanide, as explained in W. H. Safranek, "Plating on Zinc Alloy Die Castings," Chapter 26 in F. A. Lowenheim, Editor, *Modern Electroplating* (Wiley-Interscience, 3rd Edition, 1974) at pages 613–615, and as also explained in "Decorative Chromium Plating," Volume 2, *Metals Handbook* (American Society for Metals, 8th Edition, 1964) at pages 458–460. Cf. U.S. Pat. No. 3,664,993 to R. J. Clauss.

Various immersion processes, electroless processes, and autocatalytic processes also are known for plating of copper on various metals, which include zinc in some processes. Some examples of such processes are discussed hereinbelow. In connection with such processes, it is to be noted that in the electrochemical series (standard electrode potentials of metals, as related to that of hydrogen) zinc and copper differ markedly. See Table 2 in F. A. Lowenheim, op. cit., at page 776.

U.S. Pat. No. 43,557 to F. Weil discloses that a coat of copper may be deposited on zinc immersed in an alkaline solution of a copper salt and sodium-potassium tartrate, or of a copper salt and ammonia only. Sodium-potassium tartrate, which is a double salt, is known commonly as Rochelle salt.

U.S. Pat. No. 3,716,462 to D. P. Jensen discloses that copper may be plated on a body of zinc or zinc alloy in an electroless bath containing a soluble salt of copper, a complexing agent, and a reducing agent, at a pH ranging from about 5.0 to about 13.0, and that sodium hydroxide may be added if an alkaline bath is to be employed.

U.S. Pat. No. 3,033,703 to F. W. Schneble, Jr. et al. discloses a bath for electroless copper plating on various metals at a pH of at least 11.0, wherein the bath contains a copper salt, a complexing agent, and a reducing agent. Although cupric oxide and cuprous oxides ordinarily are not considered salts, both are among the "salts" listed as suitable in U.S. Pat. No. 3,033,703.

U.S. Pat. No. 4,036,651 to J. A. Weiner discloses a process of related interest, wherein a pH of 11–13.3 is specified for a bath for electroless copper plating.

U.S. Pat. No. 3,046,159 to R. R. Brookshire discloses a process for electroless copper plating on various metals in an acidic bath, wherein a complexing agent maintains a small amount of copper in solution while a large amount of copper remains out of solution in copper oxide, which is insoluble in water, and wherein a reducing agent reduces copper from solution.

As additional background, it is known that cupric oxide and cuprous oxide are insoluble in water but soluble in sodium hydroxide, whereupon little of either oxide can be dissolved in dilute aqueous solutions of sodium hydroxide.

SUMMARY OF THE INVENTION

Pursuant to this invention, surface layers of copper or copper alloyed with zinc are provided on die castings of zinc or zinc alloys by a process comprising a step of immersing the castings in an agitated bath containing an aqueous vehicle, which has been adjusted to a pH of approximately from 8 to 10, and to which cupric oxide or cuprous oxide has been added as a powder in an amount of approximately from 200 to 250 grams per liter of the agitated bath. Cupric oxide is preferred.

If the pH of the aqueous vehicle does not exceed approximately 8.5, surface layers of copper alloyed with zinc tend to be provided on the castings. Preferably, the castings are immersed for approximately from 15 to 30 seconds. Surface layers of copper alloyed with zinc tend to be more adherent than surface layers of copper.

If the pH of the aqueous vehicle exceeds approximately 8.5, surface layers of copper tend to be provided on the castings. If the pH of the aqueous vehicle is approximately 9, surface layers of copper on the castings tend to be very adherent.

The pH of the aqueous vehicle may be adjusted by addition of sodium hydroxide, potassium hydroxide, or ammonium hydroxide, preferably by addition of sodium hydroxide.

In the aqueous vehicle adjusted to a pH of approximately from 8 to 10, little of either oxide tends to be dissolved. Hence, it is assumed that zinc tends to reduce copper from either oxide of copper upon physical contact of the powder with the castings in the agitated bath, in some manner related to comparative electrode potentials of zinc and copper.

As provided on die castings of zinc or zinc alloys by a process pursuant to this invention, surface layers of copper or copper alloyed with zinc are suitable substrates for electroless nickel plating, which may be followed by decorative chromium plating.

Advantageously, no complexing agent is required, and no reducing agent is required. A process pursuant to this invention is simple, effective, and efficient.

DETAILED DESCRIPTION OF PREFERRED MODE

Die castings of zinc or zinc alloys may be provided with surface layers of copper alloyed with zinc by degreasing the castings in a conventional vapor-degreasing machine, rinsing the castings in water, cleaning the castings by immersing the castings for approximately 30 seconds in mild alkaline cleaner, rinsing the castings in water, and immersing the castings for approximately from 15 to 30 seconds in an agitated bath, which has been adjusted to a pH of approximately from 8 to 8.5 by addition of sodium hydroxide, and to which cupric oxide has been added as a powder having particle sizes of approximately 50 microns in an amount of approximately from 200 to 250 grams per liter of the agitated bath. Surface layers of copper alloyed with zinc tend to be more adherent than surface layers of copper and thus are preferred.

Die castings of zinc or zinc alloys may be provided with surface layers of copper by degreasing the castings in a conventional vapor-degreasing machine, rinsing the castings in water, cleaning the castings by immersing the castings for approximately 30 seconds in mild alkaline cleaner, rinsing the castings in water, and immersing the castings for approximately from 15 to 30 seconds in an agitated bath, which has been adjusted to a pH of more than approximately 8.5 but less than approximately 10 by addition of sodium hydroxide, and to which cupric oxide has been added as a powder having particle sizes of approximately 50 microns in an amount of approximately from 200 to 250 grams per liter of the agitated bath. If the pH of the agitated bath is approximately 9, surface layers of copper on the castings tend to be very adherent.

In each instance, after immersion in the agitated bath, the castings are rinsed in water, whereupon the castings may be subjected to conventional nickel plating, which may be followed by decorative chromium plating. The castings may be subjected to further copper plating before nickel plating. Conventional processes of further copper plating, nickel plating, and decorative chromium plating may be used.

In each instance, cuprous oxide may be substituted for cupric oxide, which is preferred. In each instance, the powder may have particle sizes up to 500 microns, or larger. Particle sizes are not critical. In each instance, potassium hydroxide, ammonium hydroxide, sodium carbonate, potassium carbonate, ammonium carbonate, trisodium phosphate, or other alkaline adjuster may be substituted for sodium hydroxide, which is preferred.

In each instance, the agitated bath may be maintained at a temperature of approximately from 20° to 35° C. Room temperature thus is satisfactory. The temperature of the agitated bath is not critical.

Also, the agitated bath may be agitated mechanically, in any conventional manner, so as to maintain the powder in suspension throughout the agitated bath. Although the agitated bath contains a dilute solution of sodium hydroxide, little of the powder dissolves in the dilute solution, even at a pH of approximately 10.

Physical contact of the powder with the castings immersed in the agitated bath seems to be essential. Supernatant liquid drawn from such a bath and free of suspended powder is ineffective for purposes of this invention.

If the pH of the agitated bath remains alkaline but falls below approximately 8, the process tends to be inoperative. If the pH of the agitated bath rises above approximately 10, copper tends not to adhere satisfactorily to the castings.

If surface layers of copper are to be provided, a process pursuant to this invention may be practiced in conjunction with a process based upon prior processes, whereupon the agitated bath also may contain Rochelle salt, as a complexing agent, and sodium hypophosphite, as a reducing agent. Deposition of copper thus is accelerated.

Such a bath containing Rochelle salt and sodium hypophosphite may contain cupric oxide (as a powder of particle size of approximately 50 microns) in an amount of approximately from 200 to 250 grams per liter of the agitated bath, Rochelle salt in an amount of approximately from 100 to 150 grams per liter of the agitated bath, sodium hypophosphite in an amount of approximately from 100 to 150 grams per liter of the agitated bath, and sodium hydroxide in an amount of approximately from 1 to 2 grams per liter of the agitated bath, whereupon the agitated bath containing Rochelle salt and sodium hypophosphite is maintained at a temperature of approximately from 38° to 49° C. (approximately from 100° to 120° F.) and at a pH of approximately from 8 to 10, and whereupon the castings are immersed for approximately from 30 to 60 seconds. After immersion in the agitated bath, the castings are rinsed in water, whereupon the castings may be subjected to further plating as discussed hereinabove.

Magnesium sulphate and calcium sulphate seem to be detrimental to a process pursuant to this invention. Small amounts of either seem to accelerate reduction of copper but to detract from adherence of copper to the castings.

Herein, all references to zinc alloys are intended to refer to the alloys used commonly for die castings, particularly but not exclusively ASTM Alloy AG40A (SAE Alloy 903) and ASTM Alloy AC41A (SAE Alloy 925) as well as ILZRO 12 and ILZRO 14. See W. H. Safranek, op. cit., at page 605.

Herein, all references to surface layers of copper are intended to refer to surface layers wherein copper is plated onto but not diffused perceptibly into a substrate of zinc or zinc alloy, and all references to surface layers of copper alloyed with zinc are intended to refer to surface layers wherein copper is diffused perceptibly into a substrate of zinc or zinc alloy. Surface layers of copper and surface layers of copper alloyed with zinc may be distinguished by color. Surface layers of copper alloyed with zinc tend to resemble brass.

I claim:

1. A process for providing surface layers of copper or copper alloyed with zinc on die castings of zinc or zinc alloys comprising a step of immersing the castings in an agitated bath containing an aqueous vehicle, which has been adjusted to a pH of approximately from 8 to 10, and to which cupric oxide or cuprous oxide has been added as a powder in an amount of approximately from 200 to 250 grams per liter of the agitated bath.

2. The process of claim 1 wherein the pH of the aqueous vehicle does not exceed approximately 8.5, whereby surface layers of copper alloyed with zinc tend to be provided on the castings.

3. The process of claim 2 wherein the castings are immersed for approximately from 15 to 30 seconds.

4. The process of claim 1 wherein the pH of the aqueous vehicle exceeds approximately 8.5, whereby surface layers of copper tend to be provided on the castings.

5. The process of claim 4 wherein the pH of the aqueous vehicle is approximately 9, whereby surface layers of copper on the castings tend to be very adherent.

6. The process of any preceding claim wherein the pH of the aqueous vehicle is adjusted by addition of sodium hydroxide, potassium hydroxide, or ammonium hydroxide.

7. The process of claim 6 wherein the pH of the aqueous vehicle is adjusted by addition of sodium hydroxide.

* * * * *